United States Patent [19]

Smith

[11] Patent Number: 4,774,916

[45] Date of Patent: Oct. 4, 1988

[54] MEASURED SHOT ETHER SYSTEM

[75] Inventor: Edward L. Smith, Brooklyn Park, Minn.

[73] Assignee: The Budd Company, Troy, Mich.

[21] Appl. No.: 13,575

[22] Filed: Feb. 11, 1987

[51] Int. Cl.[4] ..... F02M 1/16

[52] U.S. Cl. ..... 123/180 R; 123/180 E; 123/187.5 R; 222/37; 222/39

[58] Field of Search ..... 123/180 R, 180 E, 180 T, 123/187.5 R, 491; 222/36, 37, 38, 39, 639

[56] References Cited

U.S. PATENT DOCUMENTS

| | | | |
|---|---|---|---|
| 2,287,900 | 6/1942 | Parker . | |
| 2,469,751 | 5/1949 | Sweeney . | |
| 2,534,987 | 12/1950 | Price | 222/38 |
| 2,592,945 | 4/1952 | Odell | 123/187.5 R |
| 2,704,536 | 3/1955 | Edwards . | |
| 2,943,766 | 7/1960 | Orr . | |
| 2,945,483 | 7/1960 | Howell . | |
| 3,055,750 | 9/1962 | De Carolis . | |
| 3,170,599 | 2/1965 | Pianowski | 222/39 |
| 3,189,014 | 6/1965 | Kus | 123/187.5 R |
| 3,190,277 | 6/1965 | Tessier . | |
| 3,198,404 | 8/1965 | Welches . | |
| 3,297,011 | 1/1967 | Gray . | |
| 3,416,507 | 12/1968 | Little . | |
| 3,448,733 | 6/1969 | Aske . | |
| 3,655,095 | 4/1972 | Kienitz | 222/39 |
| 3,812,830 | 5/1974 | Traisnel | 123/491 |
| 3,812,890 | 5/1974 | Haas | 222/639 |
| 3,960,131 | 6/1976 | Davis . | |
| 3,999,686 | 12/1976 | Kato | 222/39 |
| 4,202,309 | 5/1980 | Burke . | |
| 4,326,485 | 4/1982 | Burke . | |
| 4,331,262 | 5/1982 | Snyder | 222/37 |
| 4,346,683 | 8/1982 | Burke . | |
| 4,671,225 | 6/1987 | Dogadko | 123/187.5 R |

*Primary Examiner*—Douglas Hart

*Attorney, Agent, or Firm*—Harness, Dickey & Pierce

[57] ABSTRACT

An automatic measured shot starting fluid assembly (10) injects a predetermined amount of starting fluid into a passageway (11) of a diesel engine. The assembly includes a power source (12) to supply electrical current and a starter motor (14) and solenoid (16) for engaging and rotating the crankshaft of the engine upon receiving electrical current from the power source (12). An ignition switch (18) interconnects the power source (12) and the starter motor solenoid (16) for allowing electrical current to flow upon closing the ignition switch (18). An atomizer (30) is disposed in the passageway (11) of the engine for atomizing the starting fluid into the passageway (11). A measured shot valve (26) is connected to a fluid cylinder (24) for measuring a predetermined amount of starting fluid from the fluid cylinder (24) and injecting the measured amount of starting fluid through a conduit (28) to the atomizer (30). A control circuit (32) interconnects the solenoid (16) and the measured shot valve (26) for allowing current to flow from the starter solenoid (16) to the measured shot valve (26) for a first predetermined interval of time to measure a predetermined amount of starting fluid. The control circuit (32) also prevents current from flowing to the measured shot valve (26) for a second predetermined interval of time between successive measured shots of starting fluid continuously upon closing of the ignition switch (18).

23 Claims, 2 Drawing Sheets

MEASURED SHOT ETHER SYSTEM

TECHNICAL FIELD

The subject invention relates to engine starting systems, and particularly to a system utilizing a measured amount of a highly volatile fluid such as ether which is injected into the engine to facilitate starting.

BACKGROUND

Numerous starting systems have been used in diesel engines to facilitate starting. For example, a highly volatile fluid such as ether is typically injected into the engine intake during the initial "cranking" of the engine. Previous systems have used a metered quantity of starting fluid which is continuously injected into the engine during the starting procedure. One such system is disclosed in U.S. Pat. No. 3,960,131, issued June 1, 1976, in the name of Davis. In that patent, a fluid cylinder of ether is connected to a valve which injects ether through a conduit to an atomizer readily secured to the engine. Further, the starter solenoid is connected to a timing switch which is normally opened and closed only after a heating resistor causes a bi-metal switch arm to snap to the open or closed position. In operation, as the ignition switch is closed, an electric circuit is completed through the heating resistor. The heating of the resistor causes the bi-metal switch arm to close and energize the solenoid of the valve into which a quantity of starting fluid is measured. Each time the bi-metal switch arm opens, the valve solenoid becomes de-energized and the previous metered quantity of fluid is injected through the conduit to the engine.

One of the problems with the above system is that a heating element is used to open and close a bi-metal switch which is subject to ambient temperatures which can lead to inaccurate control. This results in a nonuniform time interval in which the quantity of ether is injected into the engine. This tends to provide too much ether into the engine and causes engine damage.

SUMMARY OF THE INVENTION

An automatic measured shot starting fluid assembly injects a predetermined amount of starting fluid into a passageway of an engine. The assembly includes a power source to supply electrical current and a starter motor means engaging and rotating the crankshaft of the engine upon receiving electrical current from the power source. A switch means interconnects the power source and the starter motor means for allowing electrical current to flow to the starter motor means upon closing the switch means. A container means contains and supplies starting fluid. An atomizing means disposed in the passageway of the engine atomizes the starting fluid from the container means into the passageway. A valve means is connected to the container means for measuring a predetermined amount of starting fluid from the container means and injecting the measured amount of starting fluid to the atomizing means. A conduit means interconnects the valve means and the atomizing means for providing a passageway to allow the starting fluid to flow to the atomizing means. A control circuit means interconnects the starter motor means and the valve means for allowing current to flow from the starter motor means to the valve means for a first predetermined interval of time to measure a predetermined amount of starting fluid. The control circuit means also prevents current from flowing to the valve means for a second predetermined interval of time. The first and second predetermined intervals of time are continuously repeated upon closing of the switch means to provide uniform timing of starting fluid injected into the engine.

Accordingly, the subject invention is not affected by ambient air temperature, resulting in a uniform timing device to energize and de-energize the valve. The uniform time measured shot of ether prevents excessive amounts of ether from being injected into the engine which may result in engine damage. Further, the uniform timed control results in a less quantity of ether used over time.

FIGURES IN THE DRAWINGS

Other advantages of the present invention will be readily appreciated as the same becomes better understood by reference to the following detailed description which considered in connection with the accompanying drawings wherein.

DESCRIPTION OF THE PREFERRED EMBODIMENT

Figure 1:
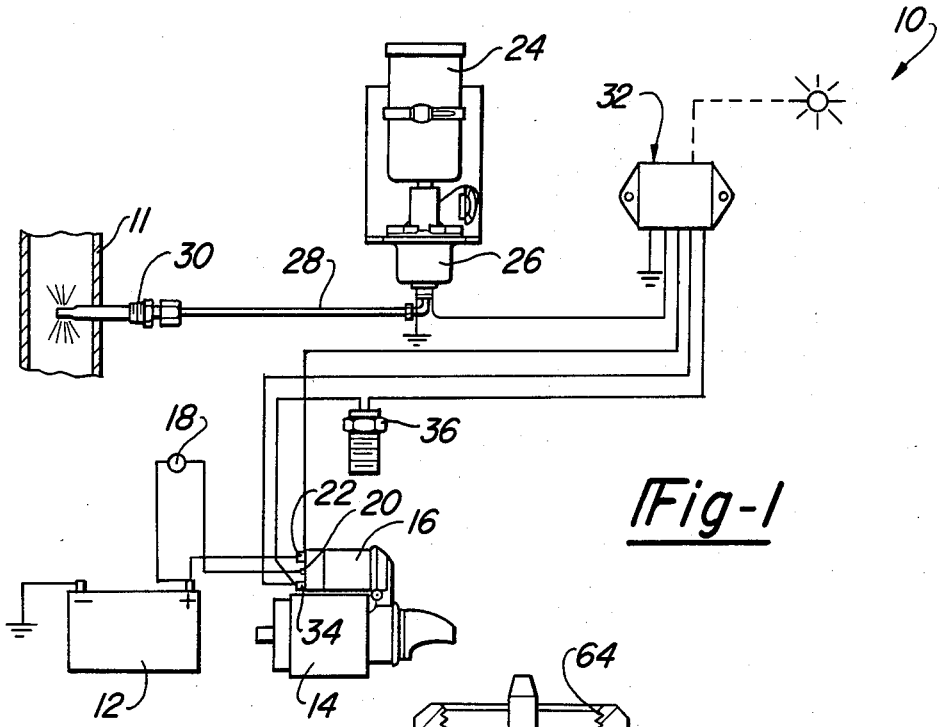
FIG. 1 is an assembly schematic of a system made in accordance with the teaching of the preferred embodiment of the subject invention.

An automatic measured shot starting fluid assembly for injecting a predetermined amount of starting fluid into a diesel engine is generally show at 10 at FIG. 1. Usually the starting fluid is injected into a passageway 11 such as the intake manifold of the engine. The assembly 10 includes a power source 12 such as a battery or the like to supply electrical current. The assembly 10 also includes a starter motor 14 having a solenoid 16. The starter motor 16 is used for engaging and rotating the crankshaft of the engine upon the solenoid 16 receiving electrical current flow from the power source 12. The assembly 10 further includes an ignition switch 18 interconnecting the power source 12 and the solenoid 16 of the starter motor 14 for allowing electrical current to flow to the solenoid 16 upon closing the ignition switch 18. More specifically, the ignition switch 18 is electrically connected to a first terminal 20 on the solenoid 16 and to the positive terminal of the power source 12. A second terminal 22 of the solenoid 16 is directly connected to the positive terminal of the power source 12. The negative terminal of the power source 12 is grounded. Hence, upon closing the ignition switch 18, a closed loop electrical cicuit is completed from the power source 12 to the solenoid 16 to energize the starter motor 14 to start or crank the engine.

The assembly 10 includes a fluid cylinder or container 24 which contains and supplies a starting fluid such as ether or the like. The assembly 10 further includes a measured shot valve 26 connected to the fluid cylinder 24 for measuring a predetermined amount of starting fluid from the fluid cylinder 24. The assembly 10 includes a conduit 28 having one end connected to the measured shot valve 26. The assembly 10 further includes an atomizer 30 disposed in the passageway 11 of the engine for atomizing the starting fluid from the fluid cylinder 24 into the passageway 11. The other end of the conduit 28 is connected to the atomizer 30.

Hence, upon energizing the measured shot valve 26, a predetermined amount of starting fluid will be measured from the fluid cylinder 24 into the valve 26 and injected into the conduit 28 and to the atomizer 30 for atomization in the passageway 11 of the engine.

The assembly 10 includes a control circuit, generally indicated at 32, interconnecting the solenoid 16 and the measured shot valve 26 for allowing current to flow from the solenoid 16 to the measured shot valve 26 for a first predetermined interval of time to measure a predetermined amount of starting fluid. The control circuit 32 also prevents current from flowing to the measured shot valve 26 for a second predetermined interval of time. The first and second predetermined time intervals are repeated continuously upon closing the ignition switch 18 to provide uniform timing of the starting fluid injected into the engine. In other words, the engine will crank briefly for a first predetermined time interval before the starting fluid is injected. Then the control circuit 32 will provide an output signal to energize valve 26. If the starter continues to crank the engine, because of no start, there will be another measured shot of ether after a second predetermined time interval. These intermittent shots will continue as long as the starter 14, 16 is engaged.

The control circuit 32 is connected to a common ground and directly to the second terminal 22 and third terminal 34 of the solenoid 16. A thermal sensor or switch 36 interconnects the control circuit 32 and the third terminal 34 of the solenoid 16 for sensing the temperature of the engine. The thermal switch 36 prevents current from flowing to the control circuit 32 above a predetermined temperature of the engine. The thermal switch 36 comprises typically a bi-metal snap action switch screwed into or fastened to the engine block, which is usually set to open at or above temperatures of 30° (degrees Farenheit). Hence, the thermal switch 36 is used to prevent injection of the starting fluid into the engine when it is not required, i.e., above a predetermined ambient temperature.

Figure 2:
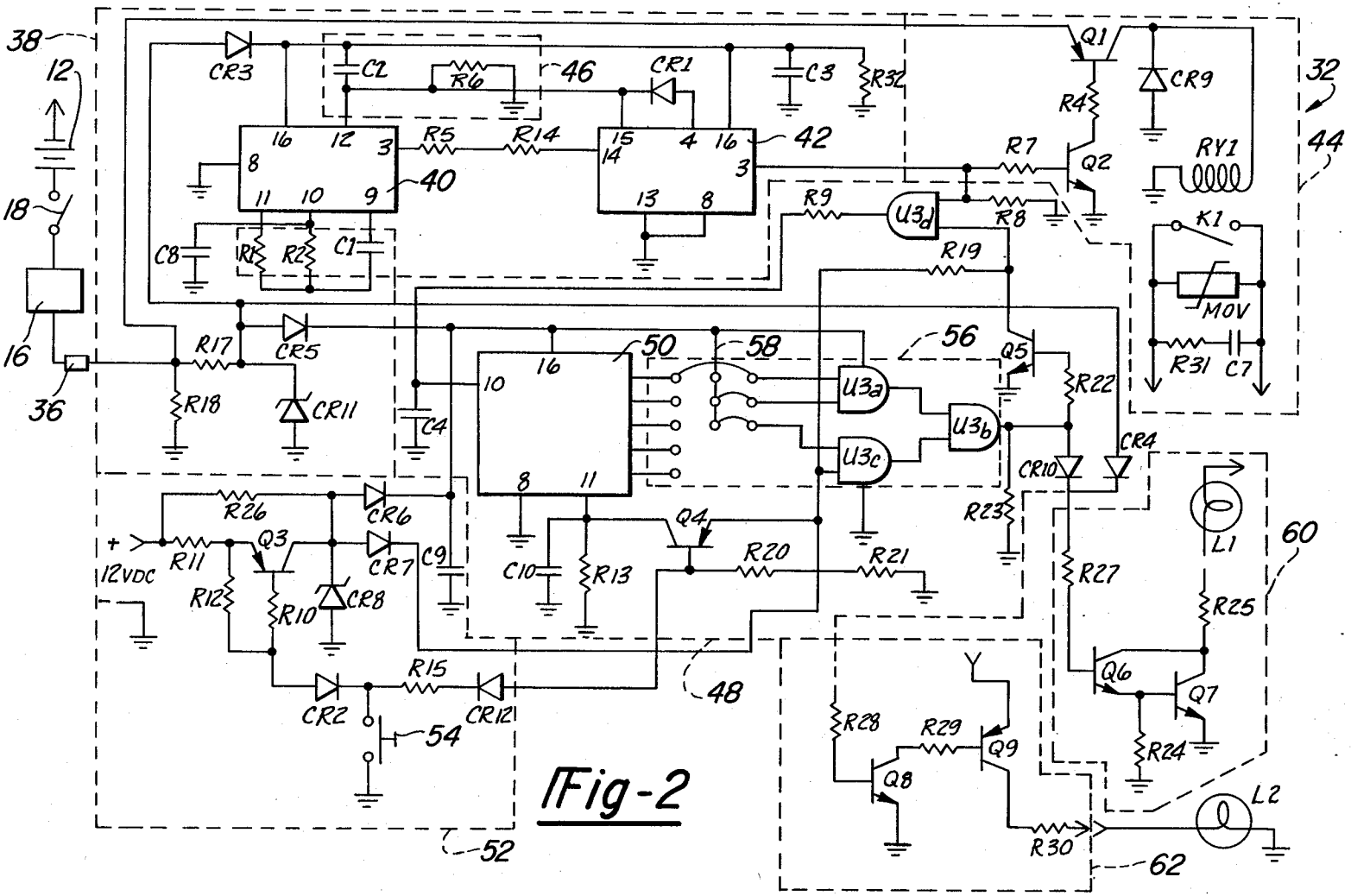
FIG. 2 is a circuit schematic of the control circuit of the subject invention.

As illustrated in FIG. 2, the control circuit 32 includes a timing circuit 38 to determine the first time period to allow current to flow to the measured shot valve 26 to activate the valve 26 to measure a predetermined amount of starting fluid. The timing circuit 38 also determines a second time period to prevent current from flowing to the valve 26 to deactivate the valve 26. The first and second predetermined time intervals are repeated continuously upon closing of the ignition switch 18 until the starter motor 16 is disengaged or the thermal switch 36 opens the electrical circuit.

The timing circuit 38 includes a first counter 40 such as a 14 stage counter oscillator for generating a stream of pulses upon receiving electrical current. Resistors R1, R2 and capacitor C1 are connected to the 11th, 10th and 9th pin of the counter 40, respectively, to act as a R/C time constant for the first counter 40. Upon closing of the ignition switch 18, current flows from the solenoid 16 through a resistor R17 and diode to the 16th pin of the counter 40. The first counter 40 generates a stream of pulses at pin 3. A second counter 42 is connected to the first counter 40 to receive the pulses. The second counter 42 is typically a decade counter and is used for counting the pulse stream from the first counter 40.

The timing circuit 38 also includes a relay drive circuit 44 having a relay RY1 and contact K1. The 3rd pin of the second counter 42 is connected to the relay RY1. When the second counter 42 receives a pulse stream from the first counter 40, the third pin of the second counter 42 goes high on the first count and generates a control signal to turn on and pull in the relay RY1 and contact K1. When the relay RY1 is activated and the contact K1 closed, the measured shot valve 26 is energized or activated for a fill cycle of a first predetermined time period of approximately two to three seconds. When the third pin of the second counter 42 reaches the fourth count, the fourth pin of the second counter 42 goes high and the relay RY1 opens, and the measured amount of starting fluid is ejected from the measured shot valve 26 through the conduit 28 to the atomizer 30. When the fourth pin of the second counter 42 goes high, a reset signal is sent from the fourth pin of the second counter 42 to a delay circuit 46 which delays the resetting of the first counter 40 for a second predetermined time interval of approximately five seconds. The reset signal from the fourth pin of the second counter 42 is sent to the 15th pin of the second counter 42 and 12th pin of the first counter 40 to reset both the second counter 42 and the first counter 40, respectively.

The control circuit 32 also includes a counting circuit 48 acting as a contents gage for determining the volume of starting fluid in the starting fluid cylinder 24. The counting circuit 48 includes a third counter 50. The third counter 50 counts the number of times the contact K1 closes which represents the energizing of valve 26 to measure a predetermined amount of starting fluid from the fluid cylinder 24. In other words, the third counter 50 acts as a reverse counter and counts off the number of times a measured shot or predetermined amount of ether is withdrawn from the fluid cylinder 24 by the measured shot valve 26. Since the fluid cylinder 24 has a predetermined volume, each measured shot represents a decrease by a predetermined amount in the fluid cylinder 24 and the remaining volume is represented by the count value on the third counter 50. The third counter 50 is a ripple counter having typically 12 stages.

The counting circuit 48 includes a memory/reset circuit 52 connected to solenoid 16 and power source 12 for supplying current to the third counter 50 for a third predetermined interval of time, typically ninety-six (96) hours, even if it becomes disengaged from power source 12 or the source loses energy. The memory-reset circuit 52 maintains the last count level on the third counter 50 when the power source 12 is disconnected from the control circuit 32 or assembly 10. The memory/reset circuit includes a resistor R26, diode CR6 and capacitor C9 connected to the 16th pin of the third counter 50. The capacitor C9 is charged by the current from the power source 12 through the resistor R26 and sixth diode CR6 when the control circuit 32 is connected to the power source 12. When the assembly 10 or control circuit 32 is disconnected from the power source 12, the energy or current that is stored in the capacitor C9 is discharged for a third predetermined interval of time to the third counter 50. The third counter 50 will retain its count value if the power source 12 is reconnected to the assembly 10 or control circuit 32 before the capacitor C9 is completely discharged.

The memory/reset circuit 52 includes a spring loaded contact or button 54. The contact 54 is connected to 11th pin of the third counter 50. When the third counter 50 is desired to be reset, the contact 54 is closed which sends a reset signal to the 11th pin of the third counter 50 to reset the third counter 50.

The counting circuit 48 also includes a programmable logic circuit 56 for generating an indicator signal to activate an indicator such as a lamp. The logic circuit 56 programmably determines the count value on the third counter 50 to generate the indicator signal in response thereto. A jumper bar 58 interconnects third counter 50 and a series of gates V3*a*, V3*b* and V3*c* to allow jumpers to be interconnected therewith for determining different count values on the third counter 50 to be indicated for different size fluid cylinders.

The control circuit 32 also includes an indicating circuit 60 for indicating when the starting fluid in the starting fluid cylinder 24 has reached a predetermined volume. The indicating circuit 60 receives the indicator signal from the logic circuit 56 of the counting circuit 48 at a predetermined value on the third counter 50 to alert the operator by powering a lamp. A lamp driver circuit 62 may also be included to drive a high source lamp or low source lamp. The lamp stays on until the reset button 54 is pushed.

The following is a table of the components used in the control circuit 32 to allow a person skilled in the art to build and use the same. The table appears as follows:

TABLE

| Components | Value | Rating | Tolerance |
|---|---|---|---|
| Resistors | | | |
| R1 | 300K | ¼ w | 5% |
| R2 | 130K | ¼ w | 5% |
| R3 | NOT USED | | |
| R4 | 1K | ¼ w | 5% |
| R5 | 10K | ¼ w | 5% |
| R6 | 10K | ¼ w | 5% |
| R7 | 22K | ¼ w | 5% |
| R8 | 22K | ¼ w | 5% |
| R9 | 22K | ¼ w | 5% |
| R10 | 470 | ¼ w | 5% |
| R11 | 68 | ½ w | 5% |
| R12 | 1K | ½ w | 5% |
| R13 | 100K | ½ w | 5% |
| R14 | 10K | ½ w | 5% |
| R15 | 1K | ½ w | 5% |
| R16 | NOT USED | | |
| R17 | 750 | ½ w | 5% |
| R18 | 1K | ½ w | 5% |
| R19 | 100K | ½ w | 5% |
| R20 | 1K | ½ w | 5% |
| R21 | 220K | ½ w | 5% |
| R22 | 100K | ½ w | 5% |
| R23 | 22K | ½ w | 5% |
| R24 | 1K | ½ w | 5% |
| R25 | 4.7 | ½ w | 5% |
| R26 | 10K | ½ w | 5% |
| R27 | 22K | ½ w | 5% |
| R28 | 22K | ½ w | 5% |
| R29 | 1K | ½ w | 5% |
| R30 | 4.7 | ½ w | 5% |
| R31 | 10 | ½ w | 5% |
| R32 | 220K | ½ w | 5% |
| Capacitors | | | |
| C1 | 1000 pf | Sprague | 592 Type |
| C2 | .1 uf | Sprague | 592 Type |
| C3 | .1 uf | Sprague | 592 Type |
| C4 | .01 uf | Sprague | 592 Type |
| C5 | NOT USED | | |
| C6 | NOT USED | | |
| C7 | .1 uf | Sprague | 592 Type |
| C8 | .001 opt. | Sprague | 592 Type |
| C9 | .047 f | Panasonic | (F5R5u473) |
| C10 | .1 uf | Sprague | 592 Type |
| Diodes | | | |
| CR1 | IN4148 | | |
| CR2 | IN4148 | | |
| CR3 | IN4148 | | |
| CR4 | IN4148 | | |
| CR5 | IN4148 | | |
| CR6 | IN4148 | | |

TABLE-continued

| Components | Value | Rating | Tolerance |
|---|---|---|---|
| CR7 | IN4148 | | |
| CR8 | IN4734 | | |
| CR9 | IN4002 | | |
| CR10 | IN4148 | | |
| CR11 | IN4734 | | |
| CR12 | IN4148 | | |
| MOV | V47MA2B (GE) | | |
| Relay and Contact | | | |
| RY1 and K1 | SIEMENS V23072-C1059-A203 | | |
| Transistors | | | |
| Q1 | MPS-A56 | | |
| Q2 | MPS-A06 | | |
| Q3 | MPS-A56 | | |
| Q4 | 2N3906 | | |
| Q5 | 2N3904 | | |
| Q6 | MPS-A06 | | |
| Q7 | MPS-UO6 | | |
| Q8 | MPS-AO6 (OPT. LAMP DRIVE) | | |
| Q9 | MPS-U56 (OPT. LAMP DRIVE) | | |
| Chips | | | |
| 40 | 4060 | | |
| 42 | 4017 | | |
| (a–c) | 74CO8 | | |
| 50 | 4040 | | |

Figure 3:
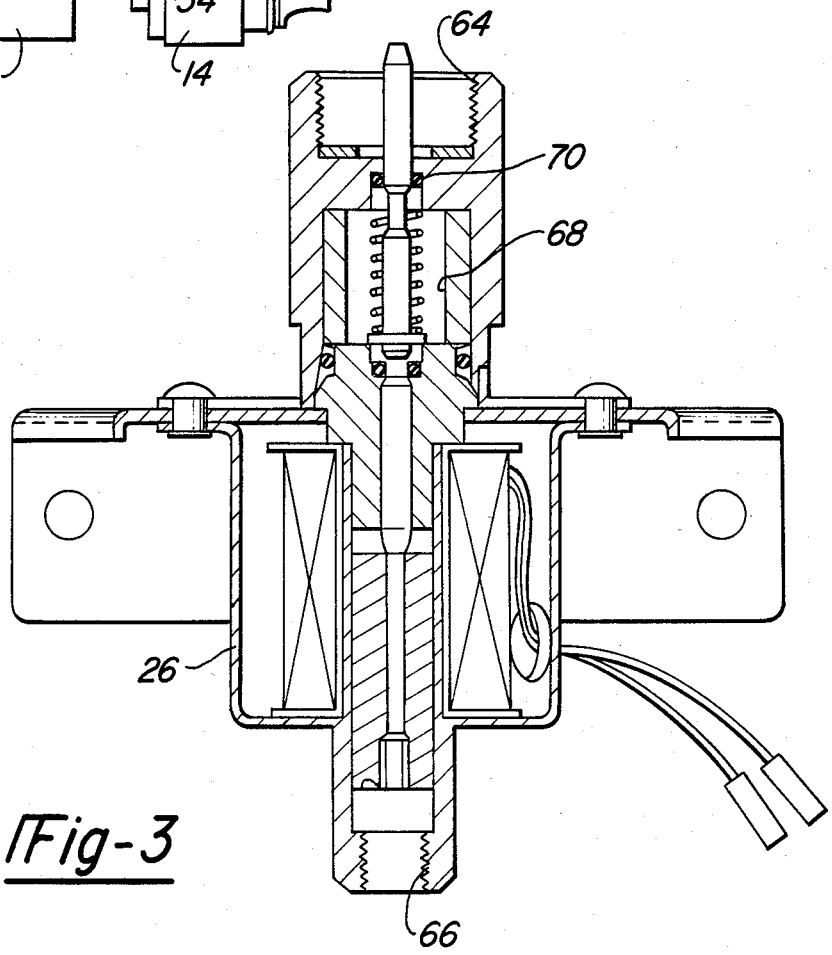
FIG. 3 is a sectional view of the measured shot valve of the subject invention.

As illustrated in FIG. 3, the measured shot valve 26 includes an inlet end 64 removably engageable with the starting fluid cylinder 24 and an outlet end 66 connected to the conduit 28. The valve 26 includes a closed chamber 68 for measuring a predetermined amount of starting fluid to be injected in the passageway 11 of the engine based on the dimensions of the chamber 68. The valve 26 also includes a seal 70 at the inlet end 64 for preventing excess starting fluid from entering the valve 26 should the valve on the fluid cylinder 32 fail.

In operation, when the ignition switch 18 is closed, current flows from the power source 12 to the solenoid 16. The solenoid 16 engages the starter motor 14 to crank the engine. Current also flows from the solenoid 16 to the control circuit 32. The first counter 40 of the control circit 32 generates a stream of pulses on receiving current from the solenoid 16. The second counter 42 which is connected to the first counter 40 counts the pulses from the first counter 40 and closes the relay RY1 and contact K1 on the first pulse count. The closing of the relay RY1 and contact K1 energizes the solenoid of the measured shot valve 26 to cause the valve on the starting fluid cylinder 24 to open. At the same time, fluid flow from the valve 26 is closed off at the engine, thus allowing the measured shot chamber 68 to be filled for approximately two to three seconds. When the second counter 42 receives the fourth count from the first counter 40, the relay RY1 is deactivated and the contact K1 opens to deactivate the measured shot valve 26. The valve of the fluid cylinder 24 is then closed, thereby shutting off the flow of starting fluid into the measured shot chamber 68. Instead, the starting fluid flows through the outlet end 66 of the measured shot valve 26 to the engine. The slight delay in injecting the ether into the engine is preferred over immediate injection because the delay insures that the engine has "turned over" before the ether is introduced. When the second counter receives the fourth count from the first counter 40, a reset signal is set to a delay circuit 46 which delays the reset signal to the first counter 40 for a second predetermined time interval of approximately five seconds. After the signal is delayed, the first counter 40 is reset. The cycle is continuously repeated until either the starter motor 14 is disengaged or the thermal switch 36 opens the electrical connection to the control circuit 32.

The invention has been described in an illustrative manner and is to be understood that the terminology which has been used is intended to be in the nature of words of description rather than of limitation. Obviously, many modifications and variations of the subject invention are possible in light of the above teachings. It is, therefore, to be understood that the subject invention may be practiced otherwise than as specifically described.

What is claimed is:

1. An automatic measures shot starting fluid assembly for injecting a predetermined amount of starting fluid into a passageway of an engine, said assembly comprising:

a power source to supply electrical current;

starter motor means connected to said power source for engaging and rotating the crankshaft of the engine upon being energized by receiving electrical current from said power source;

ignition switch means interconnecting said power source and said starter motor means for allowing electrical current to flow to said starter motor means upon closing said switch means for energizing the starter motor;

container means for containing and supplying starting fluid;

fluid atomizing means disposed in the passageway of the engine for atomizing the starting fluid from said container means into the passageway;

valve means connected to said container means for measuring a predetermined amount of starting fluid from said container means and injecting the measured amount of starting fluid to said atomizing means;

conduit means interconnecting said valve means and said atomizing means for providing a passageway to allow the starting fluid to flow to said atomizing means; and control circuit means, responsive to the ignition switch means being closed and the starter motor being energized, for activating said valve means for a first predetermined timed interval and then deactivating the valve means for a second predetermined time interval; said valve means being activated and deactivated for said first and second time intervals for so long as the ignition switch means is energizing the starter motor whereby measured shots of starting fluid are injected into the engine in a uniform manner while being minimally affected by operator intervention.

2. An assembly as set forth in claim 1 characterized by said control circuit means including counting means for determining the volume of starting fluid in said container means.

3. An assembly as set forth in claim 2 further characterized by said control circuit means including indicating means coupled to said counting means for indicating when the starting fluid in said container means has reached a predetermined volume.

4. An assembly as set forth in claim 3 including sensor means interconnecting said control circuit means and said starter motor means for sensing the temperature of the engine and preventing current from flowing to said control circuit means above a predetermined temperature of the engine.

5. An assembly as set forth in claim 1 further characterized by said valve means comprising a closed chamber for measuring a predetermined amount of starting fluid and having an inlet end removably attached to said container means and an outlet end removably attached to said conduit means.

6. An assembly as set forth in claim 5 further characterized by said valve means including sealing means at said inlet end for preventing excess starting fluid from entering said closed chamber should the valve on said container means fail.

7. An automatically measured shot starting fluid assembly having a predetermined amount of starting fluid injected into a passageway of diesel engine, the assembly including an ignition switch interconnecting a power souce and a solenoid of a starter motor to allow current to flow from the power source to the solenoid upon closing the ignition switch, and a measured shot valve for measuring a predetermined amount of starting fluid from a starting fluid cylinder and injecting the starting fluid through a conduit to an atomizer disposed in a passageway of the engine for atomizing the starting fluid, said assembly comprising:

a control circuit interconnecting the solenoid and measured shot to activate the measured shot valve upon closing of the ignition switch;

a control circuit responsive to the ignition switch means being closed and the starter motor being energized, for activating said valve for a first predetermined time interval and then deactivating the valve for a second predetermined timed interval; said valve being activated and deactivated for said first and second time intervals for so long as the ignition switch means is energizing the starter motor whereby measured shots of starting fluid are injected into the engine in a uniform manner while being minimally affected by operator intervention.

8. An assembly as set forth in claim 7 characterized by said control circuit including counting means for determining the volume of starting fluid in the starting fluid cylinder.

9. An assembly as set forth in claim 8 further characterized by said control circuit including indicating means coupled to the counting means for indicating when the starting fluid in the starting fluid cylinder has reached a predetermined volume.

10. In a control circuit for an automatic measured shot starting fluid assembly to activate a valve for injecting a predetermined amount of starting fluid supplied from a starting fluid cylinder into a passageway of a diesel engine upon receiving electrical current from a power source upon closing of an ignition switch for engaging a starter motor, the improvement comprising:

control circuit means, responsive to the ignition switch means being closed an the starter motor being energized, for activating said valve for a first predetermined time interval and then deactivating the valve for a second predetermined time interval; said valve being activated and deactivated for said first and second time intervals for so long as the ignition switch means is energizing the starter motor whereby measured shots of starting fluid are injected into the engine in a uniform manner while being minimally affected by operator intervention.

11. A control circuit as set forth in claim 10 including counting means for determining the volume of starting fluid in the starting fluid cylinder.

12. A control circuit as set forth in claim 11 including indicating means coupled to the counting means for indicating when the starting fluid in the starting fluid cylinder has reached a predetermined volume.

13. A control circuit as set forth in claim 12 characterized by said timing circuit comprising a first counter for generating a stream of pulses upon receiving electrical current and a second counter for counting the pulse stream and generating a control signal from a predetermined count value of pulses.

14. A control circuit as set forth in claim 13 further characterized by said timing circuit including a contact and a relay for closing said contact to allow current to flow to the valve upon receiving said control signal from said second counter for said first predetermined interval of time.

15. A control circuit as set forth in claim 14 further characterized by said timing circuit including delay means interconnecting said first and second counters for delaying the resetting of said first counter for said second predetermined interval of time.

16. A control circuit as set forth in claim 15 further characterized by said counting means including a third counter to count the number of times said contact closes, whereby a closing of the contact represents a volume of starting fluid being expelled from the fluid cylinder into the valve.

17. A control circuit as set forth in claim 16 including memory means for supplying current to said third counter for a third predetermined interval of time and for maintaining the last count level on said third counter when the power source is disconnected from said control circuit.

18. A control circuit as set forth in claim 17 further characterized by said memory means including reset means for resetting said third counter.

19. A control circuit as set forth in claim 18 further characterized by said counting means including logic means for programmably determining the count value on said third counter and for generating a signal to active said indicating means in response to said count value on said third counter.

20. In an apparatus for dispensing starting fluid into an engine of a vehicle having an ignition switch, the starting fluid being temporarily held in a container and fed to the engine through a selectively energizable valve wherein the improvement comprises:

control circuit means including first counter means for generating a series of pulses as long as the ignition switch is activated, second counter means coupled for receipt of the pulses from the first counter and being operative to generate output signals for energizing and de-energizing the valve, the second counter providing a first output signal after receiving a first predetermined number of pulses for activating the valve, with the second counter providing a second output signal upon receipt of a different number of pulses for deactivating the valve; and means for continuously repeating the generation of the first and second output signals as long as the ignition switch is activated.

21. The improvement of claim 20 wherein said valve means comprises a measured shot valve.

22. The improvement of claim 20 which further comprises:

visual indicator means coupled to the second counter for indicating when the volume of starting fluid in the container has fallen below a predetermined level.

23. The improvement of claim 22 wherein the indicator means includes third counter means coupled to the second counter means, operative to decrement a stored count therein upon receipt of an output signal from the second counter whereby the third counter can be used to activate a warning lamp after the valve has been energized for a predetermined number of times.

* * * * *